US006314662B1

(12) United States Patent
Ellis, III

(10) Patent No.: US 6,314,662 B1
(45) **Date of Patent: *Nov. 13, 2001**

(54) SHOE SOLE WITH ROUNDED INNER AND OUTER SIDE SURFACES

(75) Inventor: Frampton E. Ellis, III, Arlington, VA (US)

(73) Assignee: Anatomic Research, Inc., Arlington, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/522,174

(22) Filed: Mar. 9, 2000

Related U.S. Application Data

(63) Continuation of application No. 08/477,640, filed on Jun. 7, 1995, which is a continuation of application No. 08/162,962, filed on Dec. 8, 1993, now Pat. No. 5,544,429, which is a continuation of application No. 07/930,469, filed on Aug. 20, 1992, now Pat. No. 5,317,819, which is a continuation of application No. 07/239,667, filed on Sep. 2, 1988, now abandoned.

(51) Int. Cl.[7] ..... A43B 13/14

(52) U.S. Cl. ..... 36/25 R; 36/30 R; 36/31; 36/88; 36/114

(58) Field of Search ..... 36/25 R, 30 R, 36/28, 31, 32 R, 88, 91, 114, 127, 129, 69

(56) References Cited

U.S. PATENT DOCUMENTS

| | | |
|---|---|---|
| 288,127 | 11/1883 | Shepard . |
| D. 293,275 | 12/1987 | Bua . |
| D. 294,425 | 3/1988 | Le . |
| D. 296,149 | 6/1988 | Diaz . |
| D. 296,152 | 6/1988 | Selbiger . |
| D. 315,634 | 3/1991 | Yung-Mao . |
| 532,429 | 1/1895 | Rogers . |
| 1,283,335 | 10/1918 | Shillcock . |
| 1,289,106 | 12/1918 | Bullock . |
| 1,458,446 | 6/1923 | Shaeffer . |
| 1,622,860 | 3/1927 | Cutler . |
| 1,639,381 | 8/1927 | Manelas . |
| 1,701,260 | 2/1929 | Fischer . |
| 1,735,986 | 11/1929 | Wray . |

(List continued on next page.)

FOREIGN PATENT DOCUMENTS

| | | |
|---|---|---|
| 200963 | 5/1958 | (AT) . |
| 1 138 194 | 12/1982 | (CA) . |

(List continued on next page.)

OTHER PUBLICATIONS

Dorothy Williams, "*Walking on Air*", Case Alumnus, vol. LXVII, No. 6, Fall 1989, pp. 4–8.

(List continued on next page.)

*Primary Examiner*—M. D. Patterson
(74) *Attorney, Agent, or Firm*—Finnegan, Henderson, Farabow, Garrett & Dunner, L.L.P.

(57) ABSTRACT

An athletic shoe sole for a shoe has side portions with concavely rounded inner and outer surfaces, as viewed in at least a heel area and a midtarsal area of the shoe sole. The rounded surfaces increasing at least one of lateral and medial stability of the sole. The concavely rounded portion of the sole outer surface located at the heel area extends substantially continuously through a sidemost part of the sole side. The rounded portion of the sole outer surface located at the midtarsal area extends up the sole side to at least a level corresponding to a lowest point of the sole inner surface. A midsole component of the shoe sole extends into the sidemost section of the sole side and also extends up the sole side to above a level corresponding to a lowest point of the sole inner surface. The concavely rounded portions of the sole midtarsal area are located at least at the sole lateral side. The sole outer surface of at least part of the midtarsal area is substantially convexly rounded, as viewed in a shoe sole sagittal plane.

9 Claims, 12 Drawing Sheets

U.S. PATENT DOCUMENTS

| | | | | |
|---|---|---|---|---|
| 1,853,034 | | 4/1932 | Bradley . | |
| 2,120,987 | | 6/1938 | Murray . | |
| 2,147,197 | | 2/1939 | Glidden . | |
| 2,155,166 | | 4/1939 | Kraft . | |
| 2,170,652 | | 8/1939 | Brennan . | |
| 2,179,942 | | 11/1939 | Lyne . | |
| 2,328,242 | | 8/1943 | Witherill . | |
| 2,433,329 | | 12/1947 | Adler et al. . | |
| 2,434,770 | | 1/1948 | Lutey . | |
| 2,627,676 | | 2/1953 | Hack . | |
| 2,718,715 | | 9/1955 | Spilman . | |
| 2,814,133 | | 11/1957 | Herbst . | |
| 3,005,272 | | 10/1961 | Shelare et al. . | |
| 3,100,354 | | 8/1963 | Lombard et al. . | |
| 3,110,971 | | 11/1963 | Chang . | |
| 3,305,947 | | 2/1967 | Kalsoy . | |
| 3,308,560 | | 3/1967 | Jones . | |
| 3,416,174 | | 12/1968 | Novitske . | |
| 3,512,274 | | 5/1970 | McGrath . | |
| 3,535,799 | | 10/1970 | Onitsuka . | |
| 3,806,974 | | 4/1974 | Di Paolo . | |
| 3,824,716 | | 7/1974 | Di Paolo . | |
| 3,863,366 | | 2/1975 | Auberry et al. . | |
| 3,958,291 | | 5/1976 | Spier . | |
| 3,964,181 | | 6/1976 | Holcombe, Jr. . | |
| 3,997,984 | | 12/1976 | Hayward . | |
| 4,003,145 | | 1/1977 | Liebscher et al. . | |
| 4,030,213 | | 6/1977 | Daswick . | |
| 4,068,395 | | 1/1978 | Senter . | |
| 4,083,125 | | 4/1978 | Benseler et al. . | |
| 4,096,649 | | 6/1978 | Saurwein . | |
| 4,098,011 | | 7/1978 | Bowerman et al. . | |
| 4,128,951 | | 12/1978 | Tansill . | |
| 4,141,158 | | 2/1979 | Benseler et al. . | |
| 4,145,785 | | 3/1979 | Lacey . | |
| 4,149,324 | | 4/1979 | Lesser et al. . | |
| 4,161,828 | | 7/1979 | Benseler et al. . | |
| 4,161,829 | | 7/1979 | Wayser . | |
| 4,170,078 | | 10/1979 | Moss . | |
| 4,183,156 | | 1/1980 | Rudy . | |
| 4,194,310 | | 3/1980 | Bowerman . | |
| 4,217,705 | | 8/1980 | Donzis . | |
| 4,219,945 | | 9/1980 | Rudy . | |
| 4,223,457 | | 9/1980 | Borgeas . | |
| 4,227,320 | | 10/1980 | Borgeas . | |
| 4,235,026 | | 11/1980 | Plagenhoef . | |
| 4,240,214 | | 12/1980 | Sigle et al. . | |
| 4,241,523 | | 12/1980 | Daswick . | |
| 4,245,406 | * | 1/1981 | Landay et al. | 36/32 R |
| 4,250,638 | | 2/1981 | Linnemann . | |
| 4,258,480 | | 3/1981 | Famolare, Jr. . | |
| 4,259,792 | | 4/1981 | Halberstadt . | |
| 4,262,433 | | 4/1981 | Hagg et al. . | |
| 4,263,728 | | 4/1981 | Frecentese . | |
| 4,266,349 | | 5/1981 | Schmohl . | |
| 4,268,980 | | 5/1981 | Gudas . | |
| 4,271,606 | | 6/1981 | Rudy . | |
| 4,272,858 | * | 6/1981 | Hlustik | 36/11 |
| 4,274,211 | | 6/1981 | Funck . | |
| 4,297,797 | | 11/1981 | Meyers . | |
| 4,302,892 | | 12/1981 | Adamik . | |
| 4,305,212 | | 12/1981 | Coomer . | |
| 4,308,671 | * | 1/1982 | Bretschneider | 36/11 |
| 4,309,832 | | 1/1982 | Hunt . | |
| 4,316,332 | | 2/1982 | Giese et al. . | |
| 4,316,335 | | 2/1982 | Giese et al. . | |
| 4,319,412 | | 3/1982 | Muller et al. . | |
| 4,322,895 | | 4/1982 | Hockerson . | |
| 4,335,529 | | 6/1982 | Badalamenti . | |
| 4,340,626 | | 7/1982 | Rudy . | |
| 4,342,161 | | 8/1982 | Schmohl . | |
| 4,348,821 | | 9/1982 | Daswick . | |
| 4,354,319 | | 10/1982 | Block et al. . | |
| 4,361,971 | | 12/1982 | Bowerman . | |
| 4,366,634 | * | 1/1983 | Giese et al. | 36/32 R |
| 4,370,817 | | 2/1983 | Ratanangsu . | |
| 4,372,059 | | 2/1983 | Ambrose . | |
| 4,398,357 | | 8/1983 | Batra . | |
| 4,399,620 | | 8/1983 | Funck . | |
| 4,449,306 | | 5/1984 | Cavanagh . | |
| 4,451,994 | | 6/1984 | Fowler . | |
| 4,454,662 | | 6/1984 | Stubblefield . | |
| 4,455,765 | | 6/1984 | Sjöswärd . | |
| 4,455,767 | * | 6/1984 | Bergmans | 36/83 |
| 4,468,870 | | 9/1984 | Sternberg . | |
| 4,484,397 | | 11/1984 | Curley, Jr. . | |
| 4,494,321 | | 1/1985 | Lawlor . | |
| 4,505,055 | | 3/1985 | Bergmans . | |
| 4,506,462 | | 3/1985 | Cavanagh . | |
| 4,521,979 | | 6/1985 | Blaser . | |
| 4,527,345 | | 7/1985 | Lopez . | |
| 4,542,598 | | 9/1985 | Misevich et al. . | |
| 4,546,559 | | 10/1985 | Dassler . | |
| 4,557,059 | | 12/1985 | Misevich et al. . | |
| 4,559,723 | | 12/1985 | Hamy et al. . | |
| 4,559,724 | | 12/1985 | Norton . | |
| 4,561,195 | | 12/1985 | Onoda et al. . | |
| 4,577,417 | | 3/1986 | Cole . | |
| 4,578,882 | | 4/1986 | Talarico, II . | |
| 4,580,359 | | 4/1986 | Kurrash et al. . | |
| 4,624,061 | | 11/1986 | Wezel et al. . | |
| 4,624,062 | | 11/1986 | Autry . | |
| 4,641,438 | | 2/1987 | Laird et al. . | |
| 4,642,917 | | 2/1987 | Ungar . | |
| 4,651,445 | | 3/1987 | Hannibal . | |
| 4,670,995 | | 6/1987 | Huang . | |
| 4,676,010 | | 6/1987 | Cheskin . | |
| 4,694,591 | | 9/1987 | Banich et al. . | |
| 4,697,361 | | 10/1987 | Ganter et al. . | |
| 4,715,133 | | 12/1987 | Hartjes et al. . | |
| 4,724,622 | | 2/1988 | Mills . | |
| 4,727,660 | * | 3/1988 | Bernhard | 36/88 |
| 4,730,402 | | 3/1988 | Norton et al. . | |
| 4,731,939 | | 3/1988 | Parracho et al. . | |
| 4,747,220 | | 5/1988 | Autry et al. . | |
| 4,748,753 | | 6/1988 | Ju . | |
| 4,754,561 | | 7/1988 | Dufour . | |
| 4,756,098 | | 7/1988 | Boggia . | |
| 4,757,620 | | 7/1988 | Tiitola . | |
| 4,759,136 | | 7/1988 | Stewart et al. . | |
| 4,768,295 | | 9/1988 | Ito . | |
| 4,785,557 | | 11/1988 | Kelley et al. . | |
| 4,817,304 | | 4/1989 | Parker et al. . | |
| 4,827,631 | | 5/1989 | Thornton . | |
| 4,833,795 | | 5/1989 | Diaz . | |
| 4,837,949 | | 6/1989 | Dufour . | |
| 4,854,057 | | 8/1989 | Misevich et al. . | |
| 4,858,340 | | 8/1989 | Pasternak . | |
| 4,866,861 | | 9/1989 | Noone . | |
| 4,876,807 | | 10/1989 | Tiitola et al. . | |
| 4,890,398 | | 1/1990 | Thomasson . | |
| 4,906,502 | | 3/1990 | Rudy . | |
| 4,934,070 | | 6/1990 | Mauger . | |
| 4,934,073 | | 6/1990 | Robinson . | |
| 4,947,560 | | 8/1990 | Fuerst et al. . | |
| 4,949,476 | | 8/1990 | Anderie . | |
| 4,982,737 | | 1/1991 | Guttmann . | |
| 4,989,349 | | 2/1991 | Ellis, III . | |
| 5,010,662 | | 4/1991 | Dabuzhsky et al. . | |
| 5,014,449 | | 5/1991 | Richard et al. . | |
| 5,024,007 | | 6/1991 | DuFour . | |

| | | | | |
|---|---|---|---|---|
| 5,025,573 | | 6/1991 | Giese et al. . | |
| 5,052,130 | | 10/1991 | Barry et al. . | |
| 5,077,916 | | 1/1992 | Beneteau . | |
| 5,079,856 | | 1/1992 | Truelsen . | |
| 5,092,060 | | 3/1992 | Frachey et al. . | |
| 5,131,173 | | 7/1992 | Anderie . | |
| 5,224,280 | | 7/1993 | Preman et al. . | |
| 5,224,810 | | 7/1993 | Pitkin . | |
| 5,237,758 | | 8/1993 | Zachman . | |
| 5,317,819 | * | 6/1994 | Ellis, III | 36/25 R |
| 5,543,194 | | 8/1996 | Rudy . | |
| 5,544,429 | * | 8/1996 | Ellis, III | 36/25 R |
| 5,909,948 | | 6/1999 | Ellis, III . | |
| 6,115,941 | | 9/2000 | Ellis, III . | |
| 6,115,945 | | 9/2000 | Ellis, III . | |
| 6,163,982 | | 12/2000 | Ellis, III . | |

FOREIGN PATENT DOCUMENTS

| | | |
|---|---|---|
| 1 176 458 | 10/1984 | (CA) . |
| B 23257 VII/ 71a | 5/1956 | (DE) . |
| 1 287 477 | 1/1969 | (DE) . |
| 1 290 844 | 3/1969 | (DE) . |
| 1 685 260 | 10/1971 | (DE) . |
| 27 06 645 A1 | 8/1978 | (DE) . |
| 27 37 765 A1 | 3/1979 | (DE) . |
| 28 05 426 A1 | 8/1979 | (DE) . |
| 32 45 182 A1 | 5/1983 | (DE) . |
| 33 17 462 A1 | 10/1983 | (DE) . |
| 36 29 245 A1 | 3/1988 | (DE) . |
| 0 048 965 A2 | 9/1981 | (EP) . |
| 0 083 449 A1 | 7/1983 | (EP) . |
| 0 130 816 A2 | 1/1985 | (EP) . |
| 0 185 781 A1 | 7/1986 | (EP) . |
| 0 206 511 A3 | 12/1986 | (EP) . |
| 0 213 257 A3 | 3/1987 | (EP) . |
| 0 215 974 A1 | 4/1987 | (EP) . |
| 0 238 995 A2 | 9/1987 | (EP) . |
| 0 260 777 A2 | 3/1988 | (EP) . |
| 0 301 331 A2 | 2/1989 | (EP) . |
| 0 410 087 A2 | 1/1991 | (EP) . |
| 0 329 391 B1 | 5/1995 | (EP) . |
| 602.501 | 3/1926 | (FR) . |
| 925.961 | 9/1947 | (FR) . |
| 1.004.472 | 3/1952 | (FR) . |
| 1.323.455 | 2/1963 | (FR) . |
| 2 006 270 | 12/1969 | (FR) . |
| 2 261 721 | 9/1975 | (FR) . |
| 2 511 850 | 3/1983 | (FR) . |
| 2 622 411 | 5/1989 | (FR) . |
| 16143 | 9/1891 | (GB) . |
| 9591 | 11/1913 | (GB) . |
| 764956 | 1/1957 | (GB) . |
| 807305 | 1/1959 | (GB) . |
| 2 023 405 | 1/1980 | (GB) . |
| 2 039 717 | 8/1980 | (GB) . |
| 2 136 670 | 9/1984 | (GB) . |
| 39-15597 | 8/1964 | (JP) . |
| 45-5154 | 3/1970 | (JP) . |
| 50-71132 | 11/1975 | (JP) . |
| 57-139333 | 8/1982 | (JP) . |
| 59-23525 | 7/1984 | (JP) . |
| 61-55810 | 4/1986 | (JP) . |
| 61-167810 | 10/1986 | (JP) . |
| 1-195803 | 8/1989 | (JP) . |
| 3-85102 | 4/1991 | (JP) . |
| 4-279102 | 10/1992 | (JP) . |
| 5-123204 | 5/1993 | (JP) . |
| 189890 | 9/1981 | (NZ) . |
| WO 87/07480 | 12/1987 | (WO) . |
| WO 88/08263 | 11/1988 | (WO) . |
| WO 89/06500 | 7/1989 | (WO) . |
| WO 90/00358 | 1/1990 | (WO) . |
| WO 91/00698 | 1/1991 | (WO) . |
| WO 91/03180 | 3/1991 | (WO) . |
| WO 91/04683 | 4/1991 | (WO) . |
| WO 91/05491 | 5/1991 | (WO) . |
| WO 91/10377 | 7/1991 | (WO) . |
| WO 91/11124 | 8/1991 | (WO) . |
| WO 91/11924 | 8/1991 | (WO) . |
| WO 91/19429 | 12/1991 | (WO) . |
| WO 92/07483 | 5/1992 | (WO) . |
| WO 92/18024 | 10/1992 | (WO) . |
| WO 93/13928 | 7/1993 | (WO) . |
| WO 94/03080 | 2/1994 | (WO) . |
| WO 97/00029 | 1/1997 | (WO) . |
| WO 00/64293 | 11/2000 | (WO) . |

OTHER PUBLICATIONS

Brooks advertisement, *Runner's World*, Jun. 1989, p. 56+.

Nigg et al., Influence of Heel Flare and Midsole Construction on Pronation, Supination, and Impact Forces for Heel-Toe Running, *International Journal of Sport Biomechanics*, 1988, vol. 4, No. 3, pp. 205–219.

Nigg et al., The influence of lateral heel flare of running shoes on pronation and impact forces, *Medicine and Science in Sports and Exercise*, vol. 19, No.3, 1987, pp. 294–302.

*The Reebok Lineup*, Fall 1987.

P.R. Cavanagh et al., "Biological Aspects of modeling Shoe/Foot Interaction During Running," *Sport Shoes and Playing Surfaces*, 1984, pp. 24–25; 32–35; 46.

Erich Blechschmidt, The Structure of the Calcaneal Padding, *Foot & Ankle*, vol. 2, No. 5, Mar. 1982, pp. 260–283.

Cavanagh, *The Running Shoe Book*, 1980, pp. 176–180.

German description of adidas badminton shoe pre–(1989)?, 1 page.

Ellis, Executive Summary with 7 figures attached.

Originally filed specification for U.S. Patent Serial No. 09/648,792 filed Aug. 28, 2000 (ELL–10/Con).

Originally filed specification for U.S. Patent Serial No. 08/482,838 filed Jun. 7, 1995 (ELL–11).

Originally filed specification for U.S. Patent Serial No. 08/477,640 filed Jun. 7, 1995 (ELL–009/Con).

Originally filed specification for U.S. Patent Serial No. 08/479,776 filed Jun. 7, 1995 (ELL–14B).

Originally filed specification for U.S. Patent Serial No. 08/473,212 filed Jun. 7, 1995 (ELL–12B).

Originally filed specification for U.S. Patent Serial No. 08/462,531 filed Jun. 5, 1995 (ELL–12AA).

Originally filed specification for U.S. Patent Serial No. 08/452,490 filed May 30, 1995 (ELL–4/Con 3) and originally filed specification for U.S. Patent Serial No. 08/473,974 filed Jun. 7, 1995 (ELL–12M).

Originally filed specification for U.S. Patent Serial No. 08/033,468 filed Mar. 18, 1993 (ELL–006/Con 1).

* cited by examiner

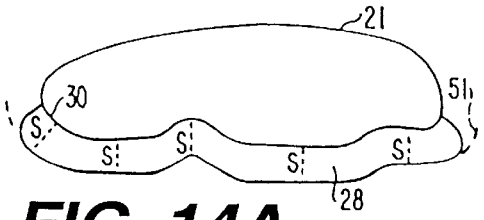
FIG. 14A
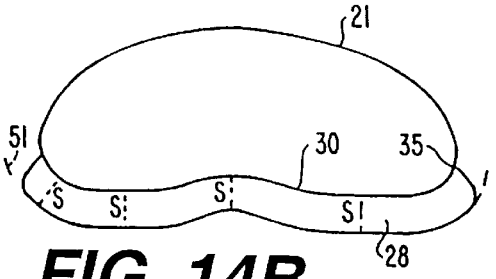
FIG. 14B
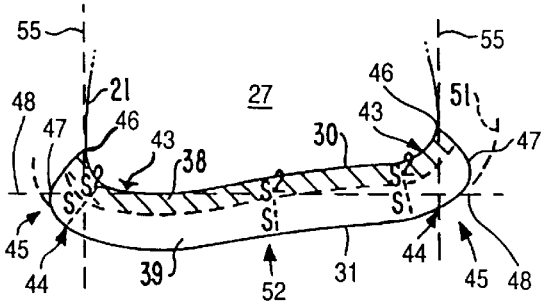
FIG. 14C
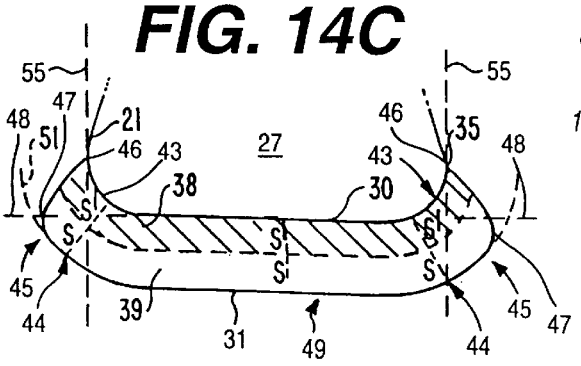
FIG. 14D
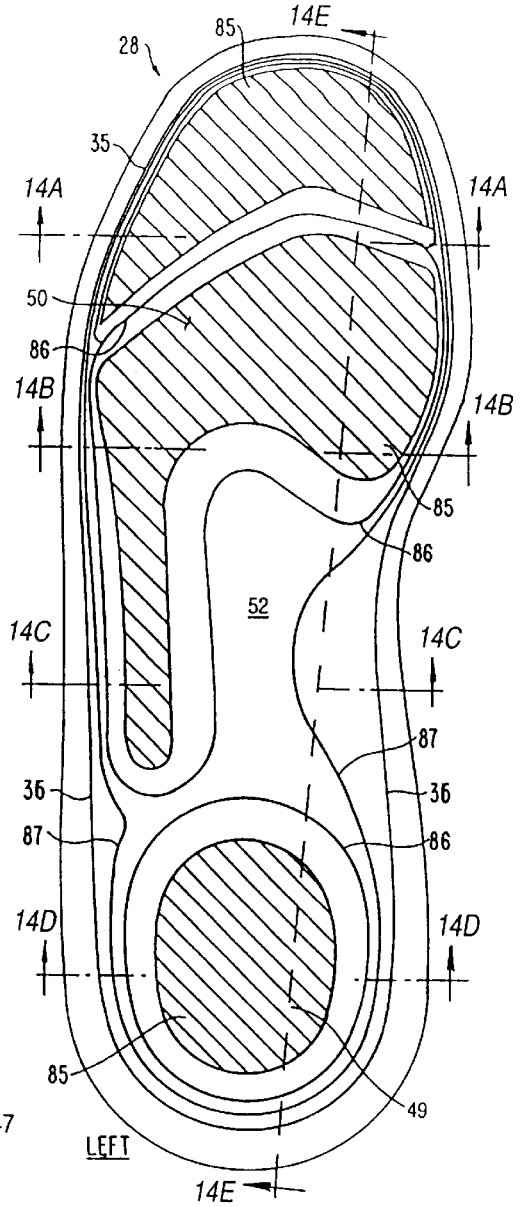
FIG. 14F
FIG. 14E
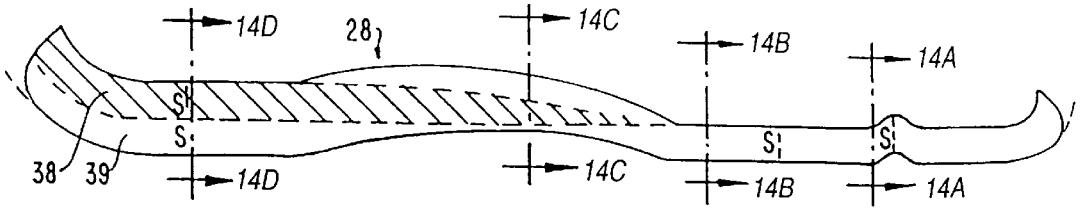

SHOE SOLE WITH ROUNDED INNER AND OUTER SIDE SURFACES

CONTINUATION DATA

This invention is a continuation of U.S. application Ser. No. 08/477,64 Jun. 7, 1995, now pending which is a continuation of U.S. application Ser. No. 08/162,962, filed Dec. 8, 1993, now U.S. Pat. No. 554429, which is a continuation of U.S. application Ser. No. 07/930,469, filed Aug. 20, 1992, now U.S. Pat. No. 5,317,819, which is a continuation of U.S. application Ser. No. 07/239,667, filed Sep. 2, 1988, now abandoned.

BACKGROUND OF THE INVENTION

This invention relates to a shoe, such as a street shoe, athletic shoe, and especially a running shoe with a contoured sole. More particularly, this invention relates to a novel contoured sole design for a running shoe which improves the inherent stability and efficient motion of the shod foot in extreme exercise. Still more particularly, this invention relates to a running shoe wherein the shoe sole conforms to the natural shape of the foot, particularly the sides, and has a constant thickness in frontal plane cross sections, permitting the foot to react naturally with the ground as it would if the foot were bare, while continuing to protect and cushion the foot.

By way of introduction, barefoot populations universally have a very low incidence of running "overuse" injuries, despite very high activity levels. In contrast, such injuries are very common in shoe shod populations, even for activity levels well below "overuse". Thus, it is a continuing problem with a shod population to reduce or eliminate such injuries and to improve the cushioning and protection for the foot. It is an understanding of the reasons for such problems, and proposing a novel solution to the problems, to which this improved shoe is directed.

A wide variety of designs are available for running shoes which are intended to provide stability, but which lead to a constraint in the natural efficient motion of the foot and ankle. However, such designs which can accommodate free, flexible motion in contrast create a lack of control or stability. A popular existing shoe design incorporates an inverted, outwardly-flared shoe sole wherein the ground engaging surface is wider than the heel engaging portion. However, such shoes are unstable ill extreme situations because the shoe sole, when inverted or on edge, immediately becomes supported only by the sharp bottom sole edge. The entire weight of the body, multiplied by a factor of approximately three at running peak, is concentrated at the sole edge. Since an unnatural lever arm and a force moment are created under such conditions, the foot and ankle are destabilized. When the destabilization is extreme, beyond a certain point of rotation about the pivot point of the shoe sole edge, ankle strain occurs. In contrast, the unshod foot is always in stable equilibrium without a comparable lever arm or force moment. At its maximum range of inversion motion, about 20°, the base of support on the barefoot heel actually broadens substantially as the calcaneal tuberosity contacts the ground. This is in contrast to the conventionally available shoe sole bottom which maintains a sharp, unstable edge.

It is thus an overall objective of this invention to provide a novel shoe design extreme range of ankle motion to near the point of ankle sprain, that the abnormal motion of an inversion ankle sprain, which is a tilting to the outside or an outward rotation of the foot, is accurately simulated while stationary. With this observation, it can be seen that the extreme range stability of the conventionally shod foot is distinctly inferior to the barefoot and that the shoe itself creates a gross instability which would otherwise not exist.

Even more important, a normal barefoot running motion, which approximately includes a 7° inversion and a 7° eversion motion, does not occur with shod feet, where a 30° inversion and eversion is common. Such a normal barefoot motion is geometrically unattainable because the average running shoe heel is approximately 60% larger than the width of the human heel. As a result, the shoe heel and the human heel cannot pivot together in a natural manner; rather, the human heel has to pivot within the shoe but is resisted from doing so by the shoe heel counter, motion control devices, and the lacing and binding of the shoe upper, as well as various types of anatomical supports interior to the shoe.

Thus, it is an overall objective to provide an improved shoe design which is not based on the inherent contradiction present in current shoe designs which make the goals of stability and efficient natural motion incompatible and even mutually exclusive. It is another overall object of the invention to provide a new contour design which simulates the natural barefoot motion in running and thus avoids the inherent contradictions in current shoe designs.

It is another objective of this invention to provide a running shoe which overcomes the problems of the prior art.

It is another objective of this invention to provide a shoe wherein the outer extent of the flat portion of the sole of the shoe includes all of the support structures of the foot but which extends no further than the outer edge of the flat portion of the foot sole so that the transverse or horizontal plane outline of the top of the flat portion of the shoe sole coincides as nearly as possible with the load-bearing portion of the foot sole.

It is another objective of the invention to provide a shoe having a sole which includes a side contoured like the natural form of the side or edge of the human foot and conforming to it.

It is another objective of this invention to provide a novel shoe structure in which the contoured sole includes a shoe sole thickness that is precisely constant in frontal plane cross sections, and therefore biomechanically neutral, even if the shoe sole is tilted to either side, or forward or backward.

It is another objective of this invention to provide a shoe having a sole fully contoured like and conforming to the natural form of the non-load-bearing human foot and deforming under load by flattening just as the foot does.

It is still another objective of this invention to provide a new stable shoe design wherein the heel lift or wedge increases in the sagittal plane the thickness of the shoe sole or toe taper decrease therewith so that the sides of the shoe sole which naturally conform to the sides of the foot also increase or decrease by exactly the same amount, so that the thickness of the shoe sole in a frontal planar cross section is always constant.

These and other objectives of the invention will become apparent from a detailed description of the invention which follows taken in conjunction with the accompanying drawings.

BRIEF DESCRIPTION OF THE DRAWINGS

In the drawings:

FIG. 6D is a top view of the shoe sole shown in FIG. 5, wherein

FIGS. 14A–14F show the naturally contoured sides design extended to the other natural contours underneath the load-bearing foot such as the main longitudinal arch;

DETAILED DESCRIPTION OF THE PREFERRED EMBODIMENTS

Figure 1:
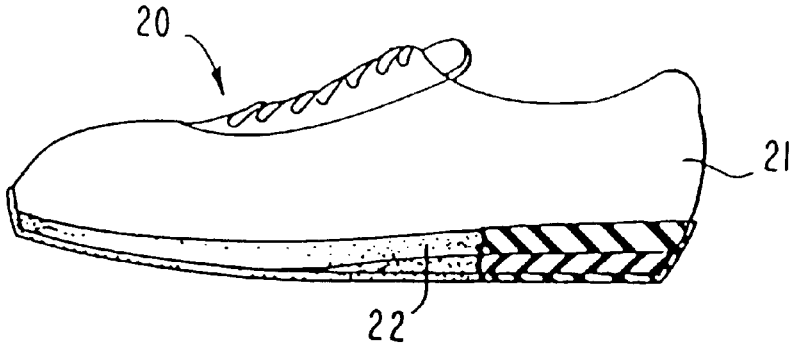
FIG. 1 (PRIOR ART)
FIG. 1 i a perspective view of a typical prior art running shoe to which the improvement of the present invention is applicable.

A perspective view of an athletic shoe, such as a typical running shoe, according to the prior art, is shown in FIG. 1 wherein a running shoe 20 includes an upper portion 21 and a sole 22. Typically, such a sole includes a truncated outwardly flared construction, wherein the lower portion of the sole heel is significantly wider than the upper portion where the sole 22 joins the upper 21. A number of alternative sole designs are known to the art, including the design shown in U.S. Pat. No. 4,449,306 to Cavanagh wherein an outer portion of the sole of the running shoe includes a rounded portion having a radius of curvature of about 20 mm. The rounded portion lies along approximately the rear-half of the length of the outer side of the mid-sole and heel edge areas wherein the remaining border area is provided with a conventional flaring with the exception of a transition zone. The U.S. Pat. No. 4,557,059 to Misevich, also shows an athletic shoe having a contoured sole bottom in the region of the first foot strike, in a shoe which otherwise uses an inverted flared sole.

Figure 2:
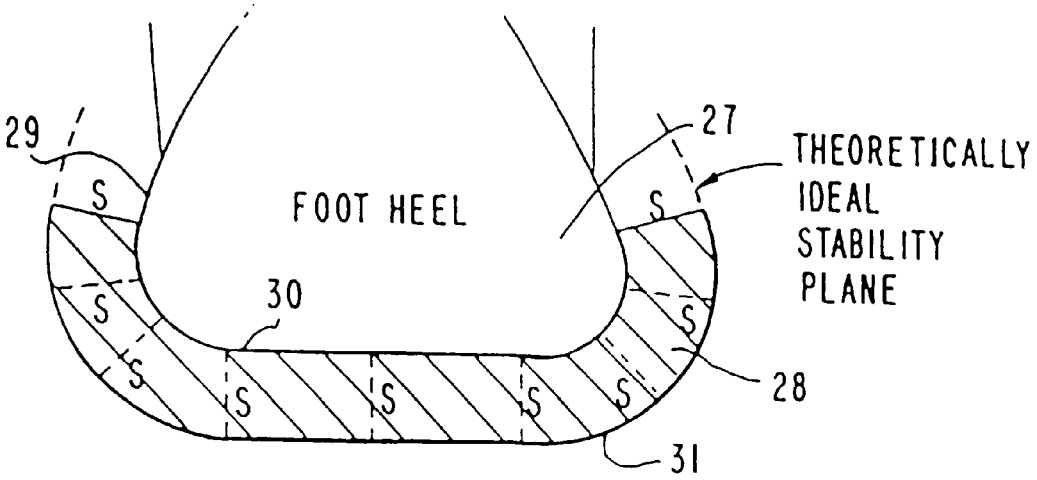
FIG. 2 a frontal plane cross section showing a shoe sole of uniform thickness that conforms to the natural shape of the human foot, the novel shoe design according to the invention.

FIG. 2 shows in a frontal plane cross section at the heel (center of ankle joint) the general concept of the applicant's design: a shoe sole 28 that conforms to the natural shape of the human foot 27 and that has a constant thickness (s) in frontal plane cross sections. The surface 29 of the bottom and sides of the foot 27 should correspond exactly to the upper surface 30 of the shoe sole 28. The shoe sole thickness is defined as the shortest distance (s) between any point on the upper surface 30 of the shoe sole 28 and the lower surface 31 by definition, the surfaces 30 and 31 are consequently parallel. In effect, the applicant's general concept is a shoe sole 28 that wraps around and conforms to the natural contours of the foot 27 as if the shoe sole 28 were made of a theoretical single flat sheet of shoe sole material of uniform thickness, wrapped around the foot with no distortion or deformation of that sheet as it is bent to the foot's contours. To overcome real world deformation problems associated with bending or wrapping around contours, actual construction of the shoe sole contours of uniform thickness will preferably involve the use of multiple sheet lamination or injection molding techniques.

Figure 3A:
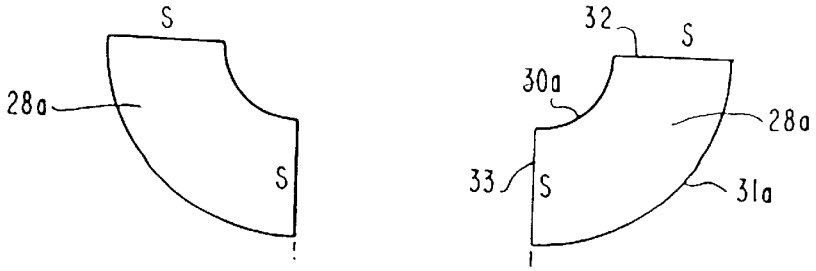
FIGS. 3A–3D show a load-bearing flat component of a shoe sole and naturally contoured stability side component, as well as a preferred horizontal periphery of the flat load-bearing portion of the shoe sole when using the sole of the invention.
Figure 3B:
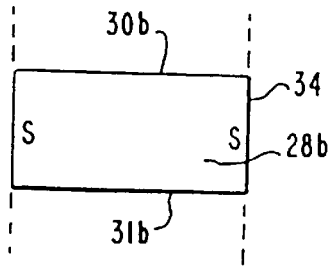
Figure 3C:
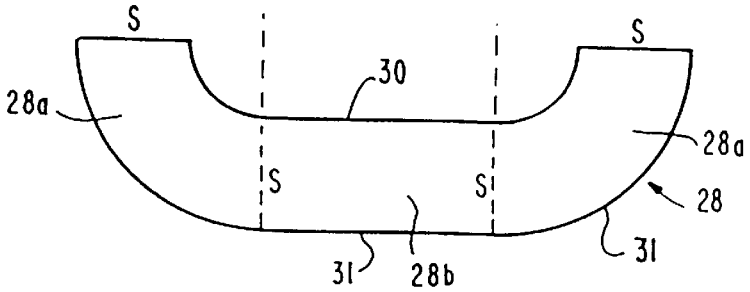
Figure 3D:
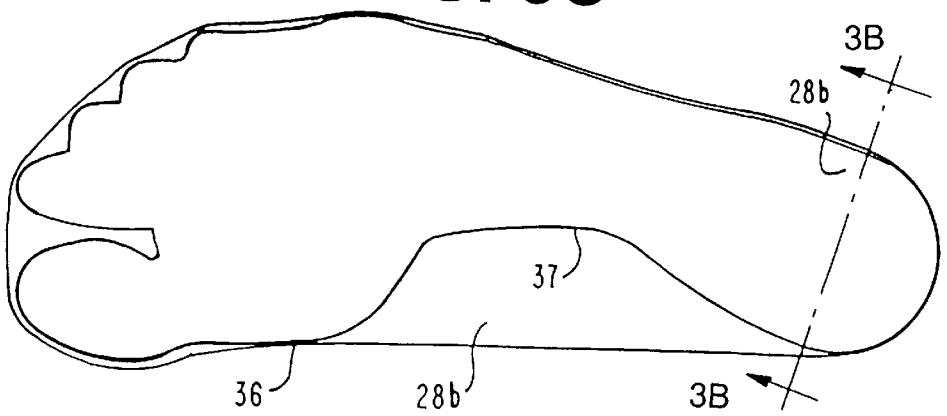
Figure 6A:
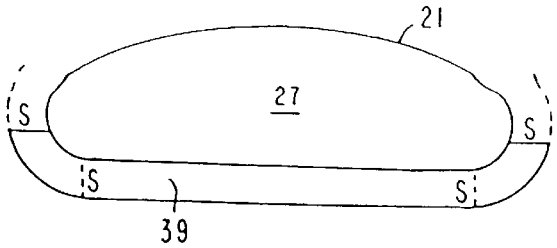
FIG. 6A is a cross-sectional view of the forefoot portion taken along lines 6A of FIGS. 5 or 6D.
Figure 6B:
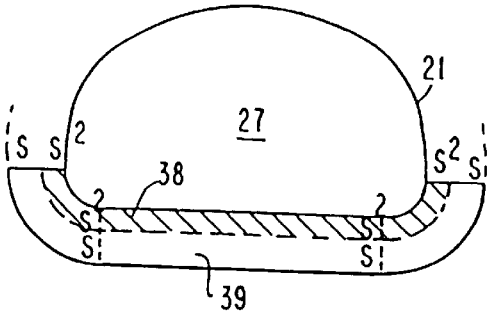
FIG. 6B is a view taken along lines 6B of FIGS. 5 and 6D.
Figure 6C:
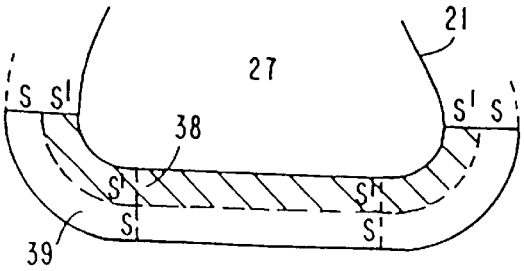
FIG. 6C is a cross-sectional view taken along Wheel along lines 6C in FIGS. 5 and 6D.
Figure 6D:
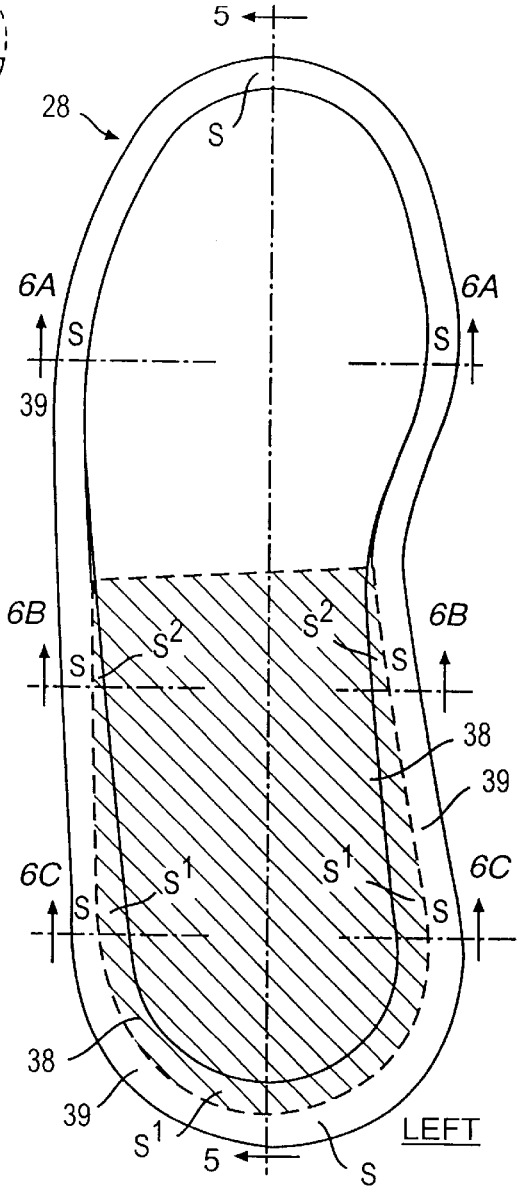
Figure 7A:
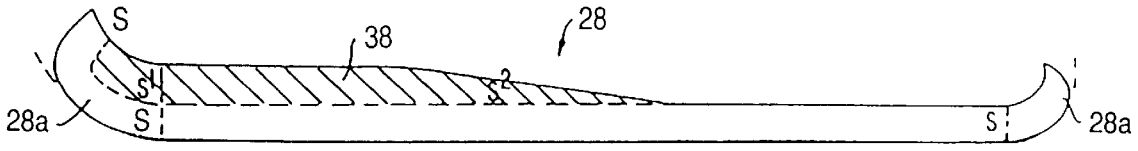
FIGS. 7A–7E show a plurality of side sagittal plane cross-sectional views showing examples of conventional sole thickness variations to which the invention can be applied
Figure 7B:
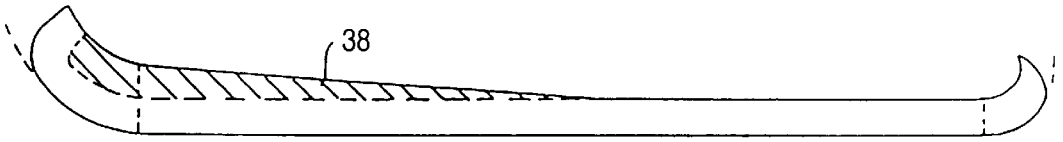
Figure 7C:
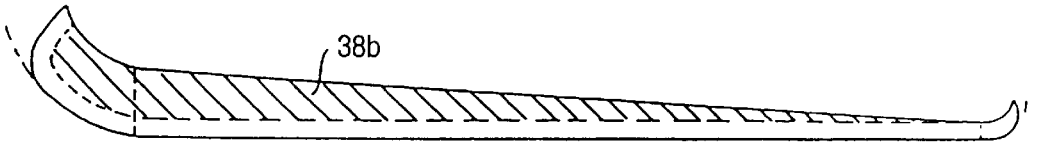
Figure 7D:
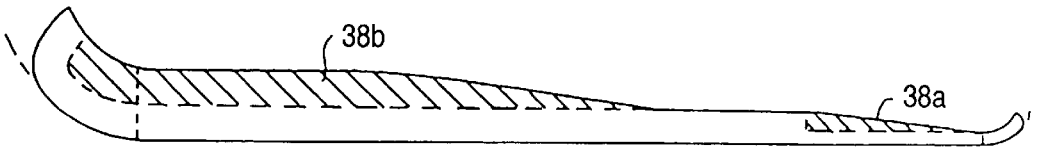
Figure 7E:
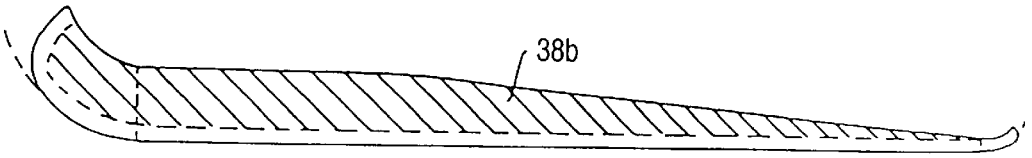

FIGS. 3A, 3B, and 3C illustrate in frontal plane cross section a significant element of the applicant's shoe design in its use of naturally contoured stabilizing sides 28*a* at the outer edge of a shoe sole 28*b* illustrated generally at the reference numeral 28. It is thus a main feature of the applicant's invention to eliminate the unnatural sharp bottom edge, especially of flared shoes, in favor of a naturally contoured shoe sole outside 31 as shown in FIG. 2. The side or inner edge 30*a* of the shoe sole stability side 28*a* is contoured like the natural form on the side or edge of the human foot, as is the outside or outer edge 31*a* of the shoe sole stability side 28*a* to follow a theoretically ideal stability plane. According to the invention, the thickness (s) of the shoe sole 28 is maintained exactly constant, even if the shoe sole is tilted to either side, or forward or backward. Thus, the naturally contoured stabilizing sides 28*a*, according to the applicant's invention, are defined as the same as the thickness 33 of the shoe sole 28 so that, in cross section, the shoe sole comprises a stable shoe sole 28 having at its outer edge naturally contoured stabilizing sides 28*a* with a surface 31*a* representing a portion of a theoretically ideal stability plane and described by naturally contoured sides equal to the thickness (s) of the sole 28. The top of the shoe sole 30*b* coincides with the shoe wearer's load-bearing footprint, since in the case shown the shape of the foot is assumed to be load-bearing and therefore flat along the bottom. A top edge 32 of the naturally contoured stability side 28*a* can be located at any point along the contoured side 29 of the foot, while the inner edge 33 of the naturally contoured side 28*a* coincides with the perpendicular sides 34 of the load-bearing shoe sole 28*b*. In practice, the shoe sole 28 is preferably integrally formed from the portions 28*b* and 28*a*. *Thus, the theoretically ideal stability plane includes the contours 31a* merging into the lower surface 31*b* of the sole 28. Preferably, the peripheral extent 36 of the load-bearing portion of the sole 28*b* of the shoe includes all of the support structures of the foot but extends no further than the outer edge of the foot sole 37 as defined by a load-bearing footprint, as shown in FIG. 3D, which is a top view of the upper shoe sole surface 30*b*. FIG. 3D thus illustrates a foot outline at numeral 37 and a recommended sole outline 36 relative thereto. Thus, a horizontal plane outline of the top of the load-bearing portion of the shoe sole, therefore exclusive of contoured stability sides, should, preferably, coincide as nearly as practicable with the load-bearing portion of the foot sole with which it comes into contact. Such a horizontal outline, as best seen in FIGS. 3D and 6D, should remain uniform throughout the entire thickness of the shoe sole eliminating negative or positive sole flare so that the sides are exactly perpendicular to the horizontal plane as shown in FIG. 3B. Preferably, the density of the shoe sole material is uniform.

Figure 4A:
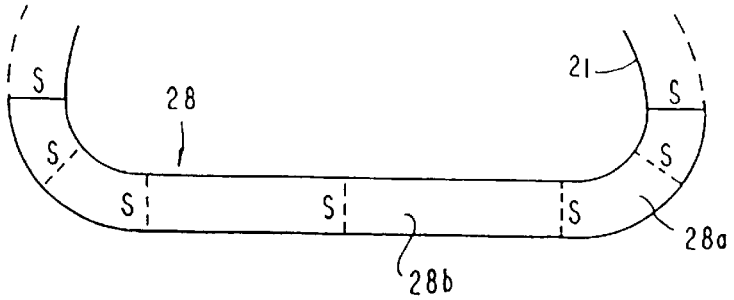
FIGS. 4A and 4B are diagrammatic sketches showing the novel contoured side sole design according to the invention with variable heel lift.
Figure 4B:
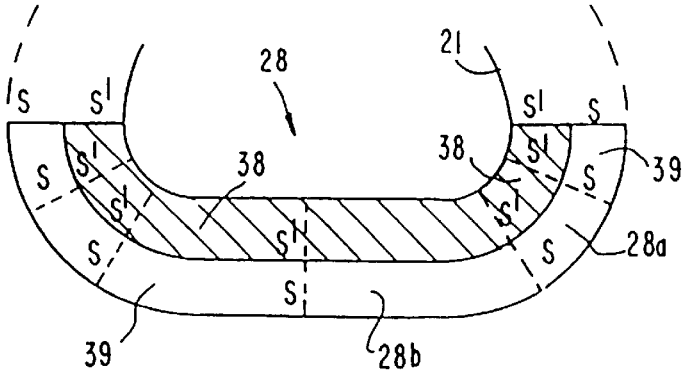

Another significant feature of the applicant's invention is illustrated diagrammatically in FIGS. 4A and 4B. Preferably, as the heel lift or wedge 38 of thickness (s1) increases the total thickness (s+s1) of the combined midsole and outersole 39 of thickness (s) in an aft direction of the shoe, the naturally contoured sides 28*a* increase in thickness exactly the same amount according to the principles discussed in connection with FIGS. 3A–3D. Thus, according to the applicant's design, the thickness of the inner edge 33 of the naturally contoured side is always equal to the constant thickness (s) of the load-bearing shoe sole 28*b* in the frontal cross-section plane.

As shown in FIG. 4B, for a shoe that follows a more conventional horizontal plane outline, the sole can be improved significantly according to the applicant's invention by the addition of a naturally contoured side 28*a* which correspondingly varies with the thickness of the shoe sole and changes in the frontal plane according to the shoe heel lift 38. Thus, as illustrated in FIG. 4B, the thickness of the naturally contoured side 28*a* in the heel section is equal to the thickness (s+s1) of the shoe sole 28 which is thicker than the shoe sole 39 thickness (s) shown in FIG. 5A by an amount equivalent to the heel lift 38 thickness (s1). In the generalized case, the thickness (s) of the contoured side is thus always equal to the thickness (s) of the shoe sole.

Figure 5:
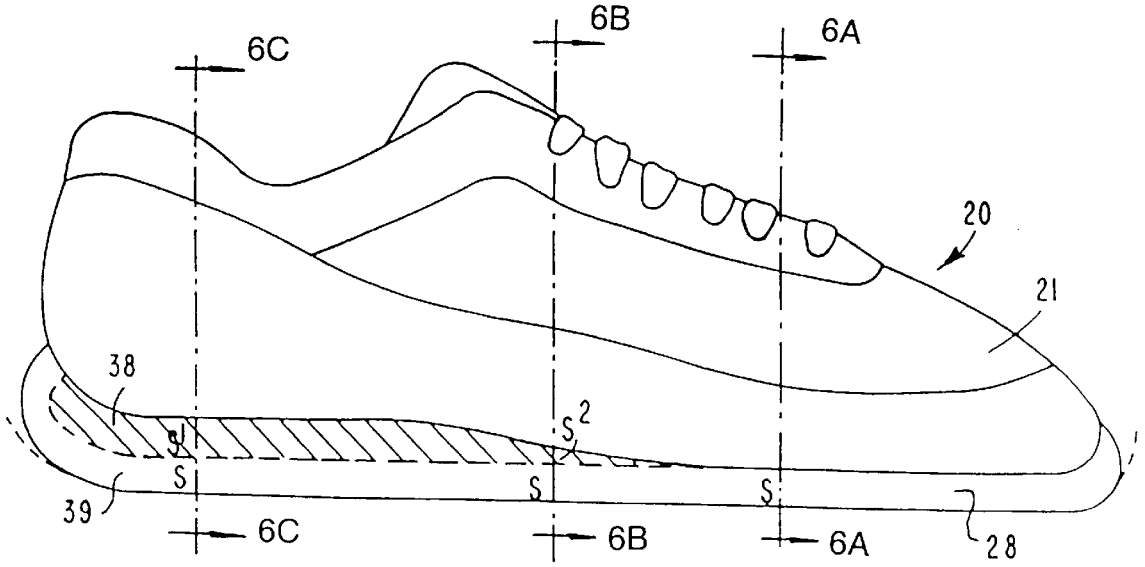
FIG. 5 is a side view of the novel stable contoured shoe according to the invention showing the contoured side design.

FIG. 5 illustrates a side cross-sectional view of a shoe to which the invention has been applied and is also shown in a top plane view in FIG. 6. Thus, FIGS. 6A, 6B and 6C represent frontal plane cross-sections taken along the forefoot, at the base of the fifth metatarsal, and at the heel, thus illustrating that the shoe sole thickness is constant at each frontal plane cross-section, even though that thickness varies from front to back, due to the heel lift 38 as shown in FIG. 5, and that the thickness of the naturally contoured sides is equal to the shoe sole thickness in each FIGS. 6A–6C cross section. Moreover, in FIG. 6D, a horizontal plane overview of the left foot, it can be seen that the contour of the sole follows the preferred principle in matching, as nearly as practical the load-bearing sole print shown in FIG. 3D.

FIGS. 7A–7E show typical conventional sagittal plane shoe sole thickness variations, such as heel lifts or wedges 38, or toe taper 38*a*, or full sole taper 38*b*, in FIGS. 7A–7E and how the naturally contured sides 28*a* equal and therefore vary with those varying thicknesses as discussed in connection with FIGS. 4A and 4B.

Figure 8A:
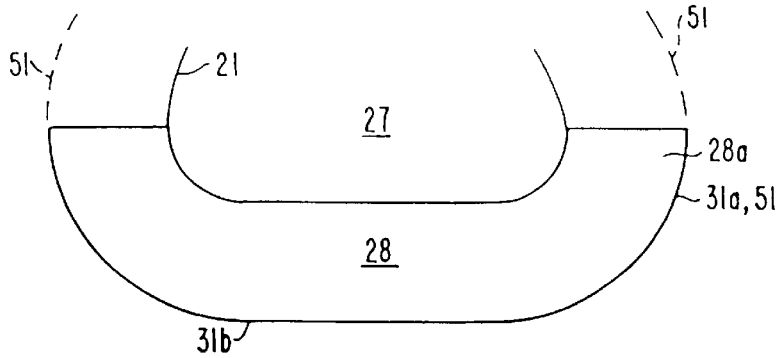
FIGS. 8A–8D show frontal plane cross-sectional views of the shoe sole according to the invention showing a theoretically ideal stability plane and truncations of the sole side contour to reduce bulk.
Figure 8B:
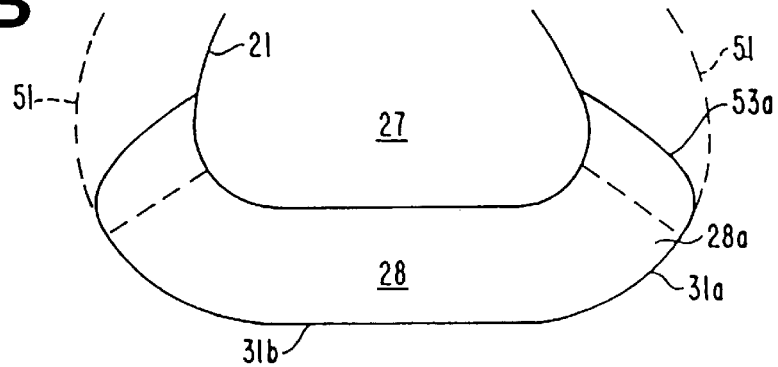
Figure 8C:
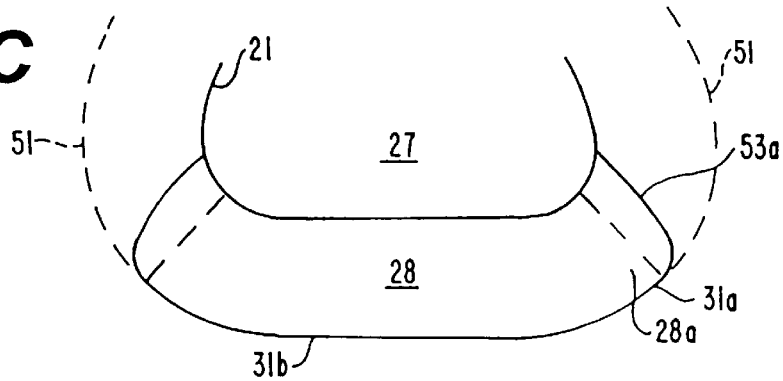
Figure 8D:
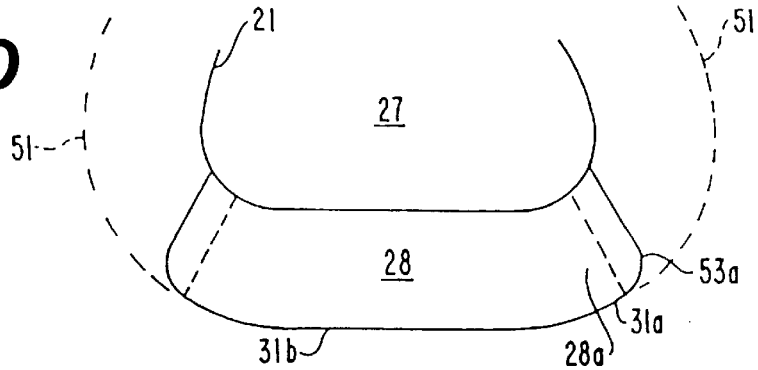

FIGS. 8A–8D illustrate an embodiment of the invention which utilizes varying portions of the theoretically ideal stability plane 51 in the naturally contoured sides 28*a* in order to reduce the weight and bulk of the sole, while accepting a sacrifice in some stability of the shoe. Thus, FIG. 8A illustrates the preferred embodiment as described above in connection with FIGS. 4A and 4B wherein the outer edge 31*a* of the naturally contoured sides 28*a* follows a theoretically ideal stability plane 51. As in FIGS. 2 and 3A–3D, the contoured surfaces 31*a*, and the lower surface of the sole 31*b* lie along the theoretically ideal stability plane 51. The theoretically ideal stability plane 51 is defined as the plane of the surface of the bottom of the shoe sole 31, wherein the shoe sole conforms to the shape of the wearer's foot sole, particularly the sides, and has a constant thickness in frontal plane cross sections. As shown in FIG. 8B, an engineering trade off results in an abbreviation within the theoretically ideal stability plane 51 by forming a naturally contoured side surface 53*a* approximating the natural contour of the foot (or more geometrically regular, which is less preferred) at an angle relative to the upper plane of the shoe sole 28 so that only a smaller portion of the contoured side 28*a* defined by the constant thickness lying along the surface 31*a* is coplanar with the theoretically ideal stability plane 51. FIGS. 8C and 8D show similar embodiments wherein each engineering trade-off shown results in progressively smaller portions of contoured side 28*a*, which lies along the theoretically ideal stability plane 51. The portion of the surface 31*a* merges into the upper side surface 53a of the naturally contoured side.

The embodiment of FIGS. 8A–8D may be desirable for portions of the shoe sole which are less frequently used so that the additional part of the side is used less frequently. For example, a shoe may typically roll out laterally, in an inversion mode, to about 20° on the order of 100 times for each single time it rolls out to 40°. For a basketball shoe, shown in FIG. 8B, the extra stability is needed. Yet, the added shoe weight to cover that infrequently experienced range of motion is about equivalent to covering the frequently encountered range. Since, in a racing shoe this weight might not be desirable, an engineering trade-off of the type shown in FIG. 8D is possible. A typical running/jogging shoe is shown in FIG. 8C. The range of possible variations is limitless, but includes at least the maximum of 90 degrees in inversion and eversion, as shown in FIG. 8A.

Figure 9A:
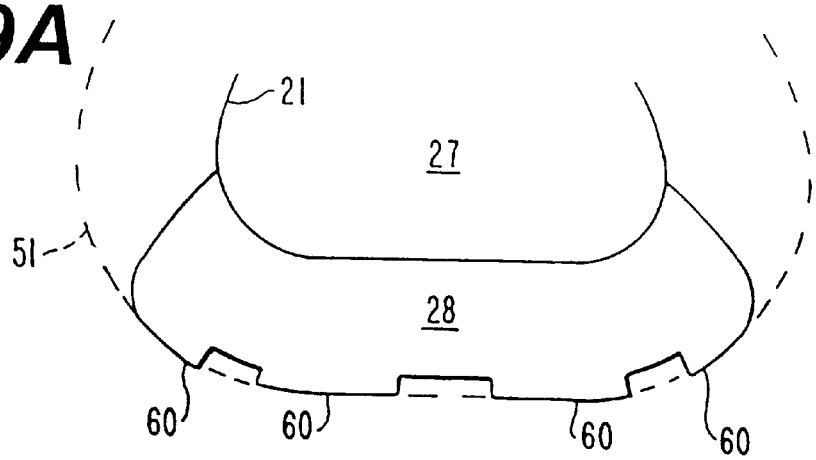
FIGS. 9A–9C show the contoured sole design according to the invention when applied to various tread and cleat patterns.
Figure 9B:
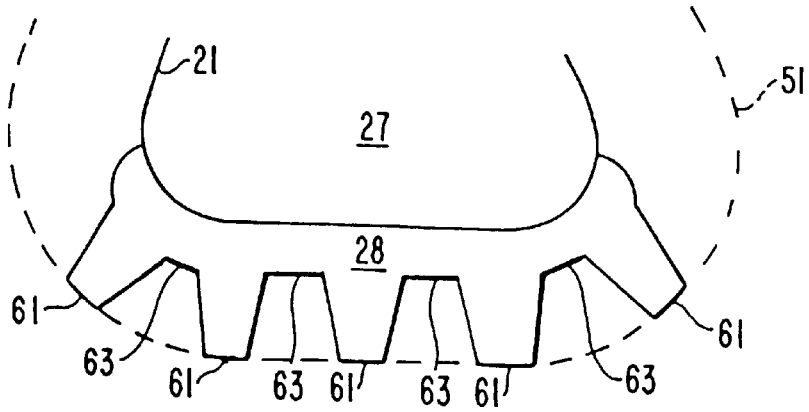
Figure 9C:
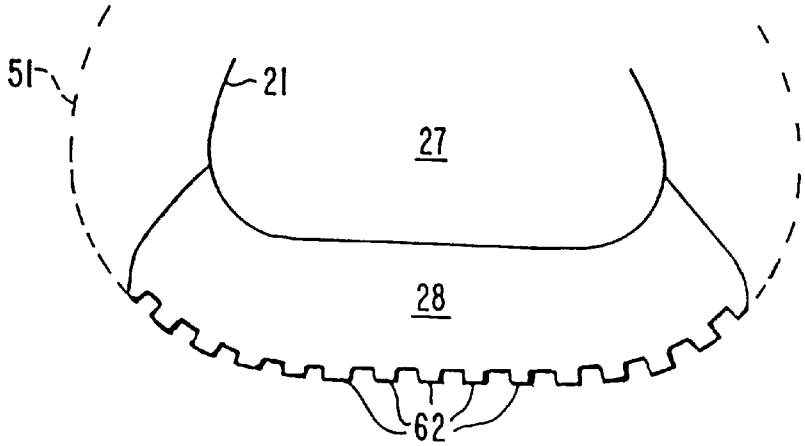

FIGS. 9A–9C show the theoretically ideal stability plane 51 in defining embodiments of the shoe sole having differing tread or cleat patterns. Thus, FIGS. 9A–9C illustrate that the invention is applicable to shoe soles having conventional bottom treads. Accordingly, FIG. 9A is similar to FIG. 8B further including a tread portion 60, while FIG. 9B is also similar to FIG. 8B wherein the sole includes a cleated portion 61. The surface 63 to which the cleat bases are affixed should preferably be on the are plane and parallel the theoretically ideal stability plane 51, since in soft ground that surface rather than the cleats become load-bearing. The embodiment in FIG. 9C is similar to FIG. 8C showing still an alternative tread construction 62. In each case, the load-bearing outer surface of the tread or cleat pattern 60–62 lies along the theoretically ideal stability plane 51.

Figure 10:
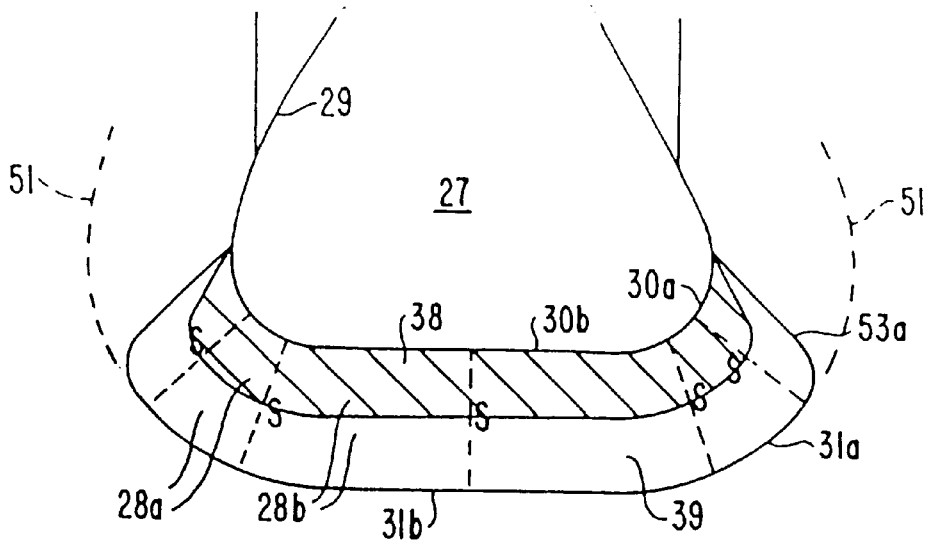
FIG. 10 illustrates, in a rear view, an application of the sole according to the invention to a shoe to provide an aesthetically pleasing and functionally effective design.

FIG. 10 shows, in a rear cross sectional view, the application of the invention to a shoe to produce an aesthetically pleasing and functionally effective design. Thus, a practical design of a shoe incorporating the invention is feasible, even when applied to shoes incorporating heel lifts 38 and a combined midsole and outersole 39. Thus, use of a sole surface and sole outer contour which track the theoretically ideal stability plane does not detract from the commercial appeal of shoes incorporating the invention.

Figure 11:
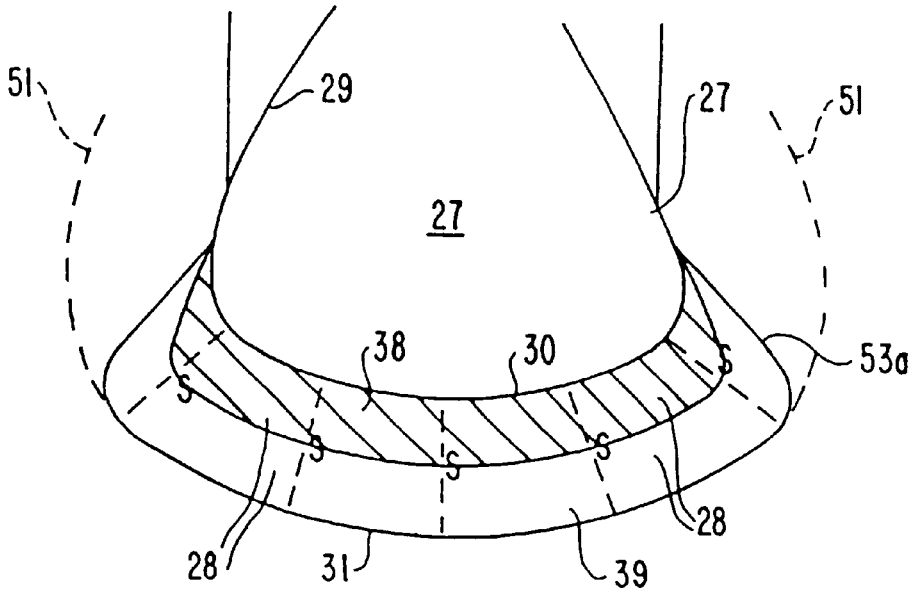
FIG. 11 shows a fully contoured shoe sole design that follows the natural contour of the bottom of the foot as well as the sides.

FIG. 11 shows a fully contoured shoe sole design that follows the natural contour of all of the foot, the bottom as well as the sides. The fully contoured shoe sole assumes that the resulting slightly rounded bottom when unloaded will deform under load and flatten just as the human foot bottom is slightly rounded unloaded but flattens under load; therefore, shoe sole material must be of such composition as to allow the natural deformation following that of the foot. The design applies particularly to the heel, but to the rest of the shoe sole as well. By providing the closest match to the natural shape of the foot, the fully contoured design allows the foot to function as naturally as possible. Under load, FIG. 11 would deform by flattening to look essentially like FIG. 10. Seen in this light, the naturally contoured side design in FIG. 10 is a more conventional, conservative design that is a special case of the more general fully contoured design in FIG. 11, which is the closest to the natural form of the foot, but the least conventional. The amount of deformation flattening used in the FIG. 10 design, which obviously varies under different loads, is not an essential element of the applicant's invention.

FIGS. 10 and 11 both show in frontal plane cross section the essential concept underlying this invention, the theoretically ideal stability plane, which is also theoretically ideal for efficient natural motion of all kinds, including running, jogging or walking. FIG. 11 shows the most general case of the invention, the fully contured design, which conforms to the natural shape of the unloaded foot. For any given individual, the theoretically ideal stability plane 51 is determined, first, by the desired shoe sole thickness (s) in a frontal plane cross section, and, second, by the natural shape of the individual's foot surface 29, to which the theoretically ideal stability plane 51 is by definition parallel.

For the special case shown in FIG. 10, the theoretically ideal stability plane for any particular individual (or size average of individuals) is determined, first, by the given frontal plane cross section shoe sole thickness (s); second, by the natural shape of the individual's foot; and, third, by the frontal plane cross section width of the individual's load-bearing footprint 30*b*, which is defined as the upper surface of the shoe sole that is in physical contact with and supports the human foot sole, as shown in FIGS. 3A–3D.

The theoretically ideal stability plane for the special case is composed conceptually of two parts. Shown in FIGS. 10 and 3A–3D the first part is a line segment 31*b* of equal length and parallel to 30*b* at a constant distance (s) equal to shoe sole thickness. This corresponds to a conventional shoe sole directly underneath the human foot, and also corresponds to the flattened portion of the bottom of the load bearing foot sole 28*b*. The second part is the naturally contoured stability side outer edge 31*a* located at each side of the first part, line segment 31*b*. Each point on the contoured side outer edge 31*a* is located at a distance which is exactly shoe sole thickness (s) from the closest point on the contoured side inner edge 30*a*;

consequently, the inner and outer contoured edges 31A and 30A are by definition parallel.

In summary, the theoretically ideal stability plane is the essence of this invention because it is used to determine a geometrically precise bottom contour of the shoe sole based on a top contour that conforms to the contour of the foot. This invention specifically claims the exactly determined geometric relationship just described. It can be stated unequivocally that any shoe sole contour, even of similar contour, that exceeds the theoretically ideal stability plane will restrict natural foot motion, while any less than that plane will degrade natural stability, in direct proportion to the amount of the deviation.

Figure 12:
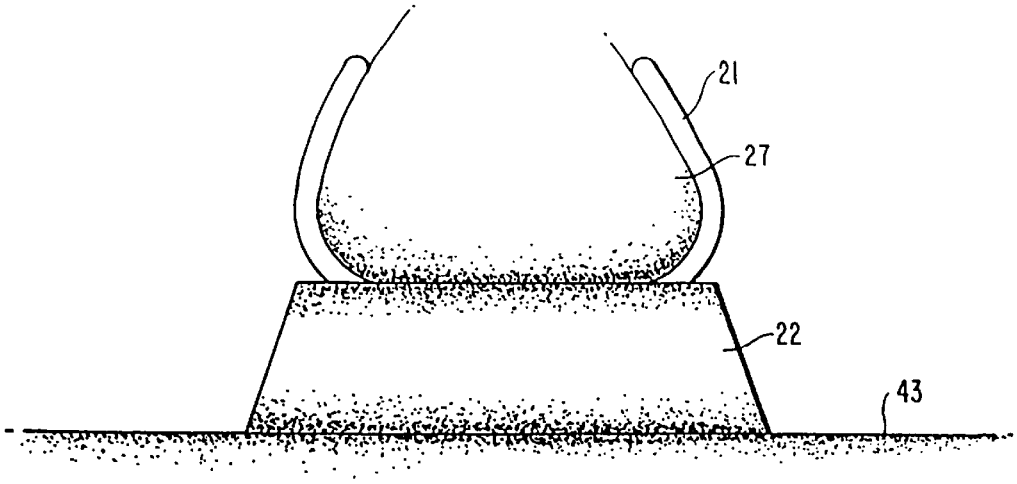
FIGS. 12 and 13 show a rear diagrammatic view of a human heel, as relating to a conventional shoe sole (FIG. 12) and to the sole of the invention (FIG. 13)

FIG. 12 illustrates, in a pictorial fashion, a comparison of a cross section at the ankle joint of a conventional shoe with a cross section of a shoe according to the invention when engaging a heel. As seen in FIG. 12, when the heel of the foot 27 of the wearer engages an upper surface of the shoe sole 22, the shape of the foot heel and the shoe sole is such that the conventional shoe sole 22 conforms to the contour of the ground 43 and not to the contour of the sides of the foot 27. As a result, the conventional shoe sole 22 cannot follow the natural 7° inversion/eversion motion of the foot, and that normal motion is resisted by the shoe upper 21, especially when strongly reinforced by firm heel counters and motion control devices. This interference with natural motion represents the fundamental misconception of the currently available designs. That misconception on which existing shoe designs are based is that, while shoe uppers are considered as a part of the foot and conform to the shape of the foot, the shoe sole is functionally conceived of as a part of the ground and is therefore shaped flat like the ground, rather than contoured like the foot.

Figure 13:
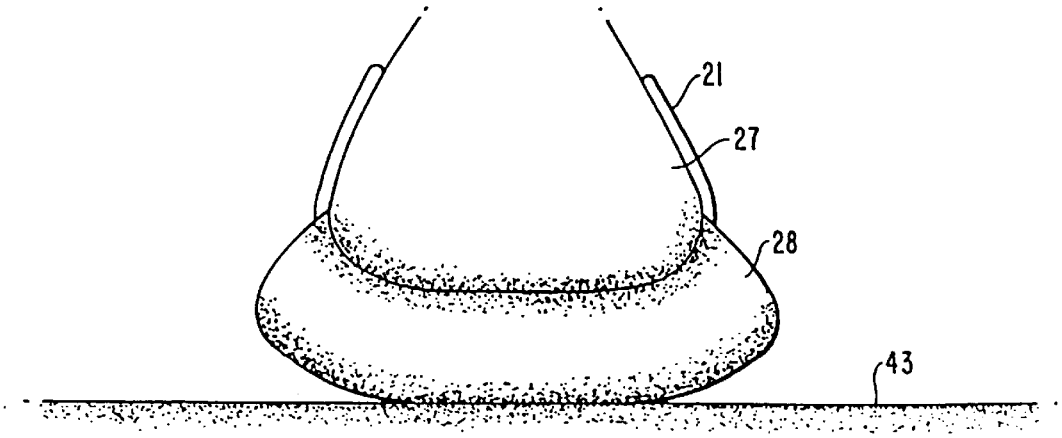
Figure 15A:
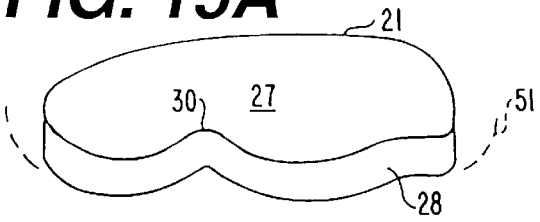
FIGS. 15A–15E illustrate he fully contoured shoe sole design extended to the bottom of the entire none-bearing foot.
Figure 15B:
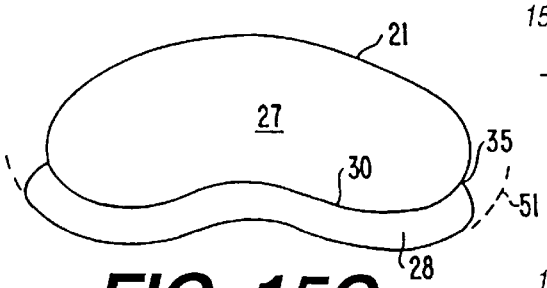
Figure 15C:
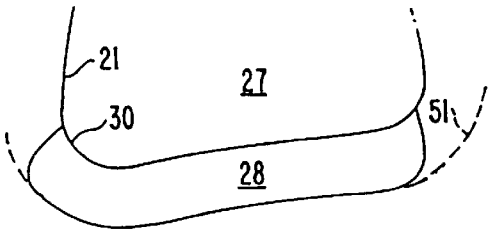
Figure 15D:
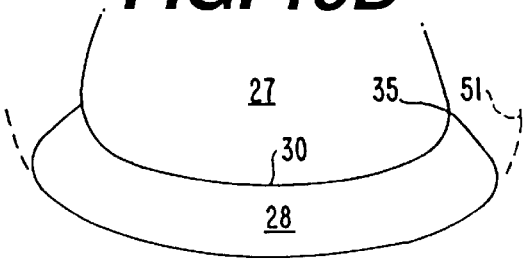

In contrast, the new design, as illustrated in FIG. 13, illustrates a correct conception of the shoe sole 28 as a part of the foot and an extension of the foot, with shoe sole sides contoured exactly like those of the foot, and with the frontal plane thickness of the shoe sole between the foot and the ground always the same and therefore completely neutral to the natural motion of the foot. With the correct basic conception, as described in connection with this invention, the shoe can move naturally with the foot, instead of restraining it, so both natural stability and natural efficient motion coexist in the same shoe, with no inherent contradiction in design goals.

Thus, the contoured shoe design of the invention brings together in one shoe design the cushioning and protection typical of modern shoes, with the freedom from injury and functional efficiency, meaning speed, and/or endurance, typical of barefoot stability and natural freedom of motion. Significant speed and endurance improvements are anticipated, based on both improved efficiency and on the ability of a user to train harder without injury.

FIGS. 14A–14D illustrate, in frontal plane cross sections, the naturally contoured sides design extended to the other natural contours underneath the load-bearing foot, such as the main longitudinal arch, the metatarsal (or forefoot) arch, and the ridge between the heads of the metatarsals (forefoot) and the heads of the distal phalanges (toes). As shown, the shoe sole thickness remains constant as the contour of the shoe sole follows that of the sides and bottom of the load-bearing foot. FIG. 14E shows; a sagittal plane cross section of the shoe sole conforming to the contour of the bottom of the load-bearing foot, with thickness varying according to the heel lift 38. FIG. 14F shows a horizontal plane top view of the left foot that shows the areas 85 of the shoe sole that correspond to the flattened portions of the foot sole that are in contact with the ground when load-bearing. Contour lines 86 and 87 show approximately the relative height of the shoe sole contours above the flattened load-bearing areas 85 but within roughly the peripheral extent 35 of the upper surface of sole 30 shown in FIGS. 3A–3D. A horizontal plane bottom view (not shown) of FIG. 14F would be the exact reciprocal or converse of FIG. 14F (i.e. peaks and valleys contours would be exactly reversed).

More particularly, FIGS. 14C and 14D disclose a shoe sole 28 having a sole inner surface 30 adjacent the location of an intended wearer's foot 27 inside the shoe including at least a first concavely rounded portion 43, as viewed in a frontal plane. The concavity being determined relative to the location of an intended wearer's foot 27 inside the shoe, during an upright, unloaded shoe condition. The shoe sole 28 further includes a lateral or medial sidemost section 45 defined by that part of the side of the shoe sole 28 located outside of a straight line 55 extending vertically from a sidemost extent 46 of the sole inner surface 30, as viewed in the frontal plane during a shoe upright, unloaded condition. A sole outer surface 31 extends from the sole inner surface 30 and defines the outer boundary of the sidemost section 45 of the side of the shoe sole 28, as viewed in the frontal plane. The shoe sole 28 further including a second concavely rounded portion 44 forming at least the outer sole surface 31 of tile sidemost section 45, the concavity being determined relative to the location of an intended wearer's foot 27 inside the shoe, as viewed in the frontal plane during a shoe upright, unloaded condition. The second concavely rounded portion 44 extending through a sidemost extent 47 of the sole outer surface 31 of the sole sidemost section 45, as viewed in the frontal plane during an upright, unloaded condition. Further, the second concavely rounded portion 44 extends to a height above a horizontal line 48 through the lowermost point of the sole inner surface 30, as viewed in the frontal plane in the heel area 51 during an upright, unloaded shoe condition. FIG. 14C illustrates the above aspects of the shoe sole 28 at the shoe midtarsal area 52 located between the forefoot area 50 and the heel area 49.

Figure 15E:
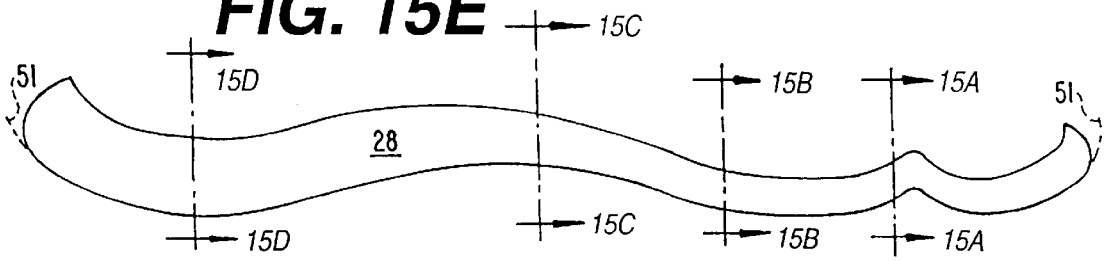
Figure 17:
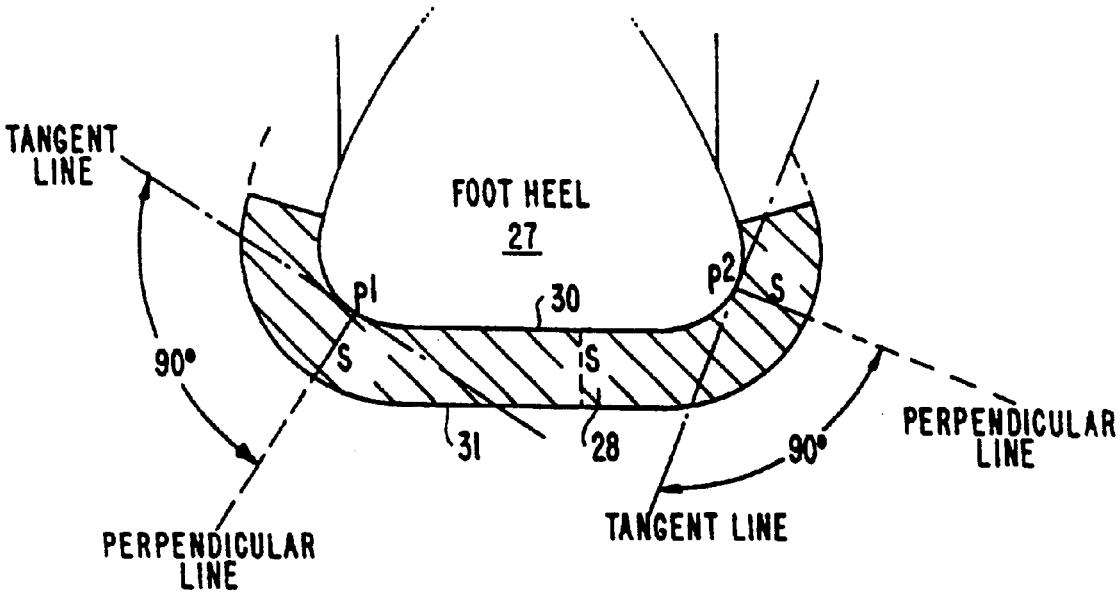
FIG. 17 is a frontal plane cross section at the heel showing uniform thickness.

FIGS. 15A–15D show, in frontal plane cross sections, the fully contoured shoe sole design extended to the bottom of the entire non-load-bearing foot. FIG. 15E shows a sagittal plane cross section. The shoe sole contours underneath the foot are the same as FIGS. 14A–14E except that there are no flattened areas corresponding to the flattened areas of the load-bearing foot. The exclusively rounded contours of the shoe sole follow those of the unloaded foot. A heel lift 38, the same as that of FIGS. 14A–14D, is incorporated in this embodiment, but is not shown in FIGS. 15A–15D.

Figure 16:
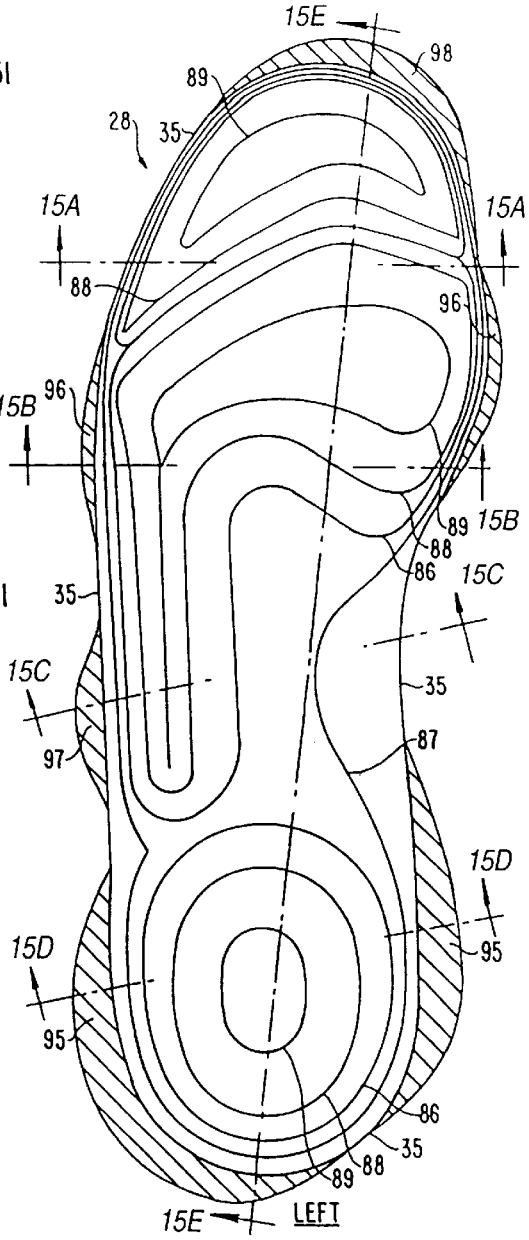
FIG. 16 shows the fully contoured shoe sole design abbreviated along the sides to only essential structural support and propulsion elements.

FIG. 16 shows the horizontal plane top view of the left foot corresponding to the fully contoured design described in FIGS. 14A–14E, but abbreviated along the sides to only essential structural support and propulsion elements. Shoe sole material density can be increased in the unabbreviated essential elements to compensate for increased pressure loading there. The essential structural support elements are the base and lateral tuberosity of the calcaneus 95, the heads of the metatarsals 96, and the base of the fifth metatarsal 97. They must be supported both underneath and to the outside for stability. The essential propulsion element is the head of first distal phalange 98. The medial (inside) and lateral (outside) sides supporting the base of the calcaneus are shown in FIG. 15 oriented roughly along either side of the horizontal plane subtalar ankle joint axis, but can be located also more conventionally along the longitudinal axis of the shoe sole. FIG. 15 shows that the naturally contoured stability sides need not be used except in the indentified essential areas. Weight savings and flexibility improvements can be made by omitting the non-essential stability sides. Contour line,s 86 through 89 show approximately the relative height of the shoe sole contours within roughly the peripheral extent [35 of the undeformed upper surface of shoe sole 30 shown in FIG. 3A–3D. A horizontal plane bottom view (not shown) of FIG. 15 would be the exact reciprocal or converse of FIG. 15 (i.e. peaks and valleys contours would be exactly reversed).

Thus, it will clearly be understood by those skilled in the art that the foregoing description has been made in terms of the preferred embodiment and various changes and modifications may be made without departing from the scope of the present invention which is to be defined by the appended claims.

What is claimed is:

1. A sole for an athletic shoe having at least one side portion with a rounded midsole inner surface and a rounded sole outer surface located at least at a heel area and also at a lateral midtarsal area to increase at least one of lateral and medical stability of the sole, the athletic shoe sole comprising:

a midsole component and an outsole component;

a sole heel area of the athletic shoe sole at a location substantially corresponding to the location of a heel of the intended wearer's foot when inside the shoe;

a sole forefoot area of the athletic shoe sole at a location substantially corresponding to the location of a forefoot of the intended wearer's foot when inside the shoe;

a sole midtarsal area of the athletic shoe sole at a location substantially corresponding to the area between the heel and the forefoot of the intended wearer's foot when inside the shoe;

the sole including a lateral sidemost section and a medial sidemost section, each at a location outside of a straight vertical line extending through the sole at a respective sidemost extent of an inner surface of the midsole component, as viewed in a shoe sole frontal plane cross section during an unloaded, upright shoe sole condition;

a greater sole thickness in the sole heel area than a sole thickness in the sole forefoot area, as viewed in a shoe sole sagittal plane cross section, during an unloaded, upright shoe sole condition;

at least one heel area sole side located at one of a sole lateral side and a sole medial side, said lateral and medial sides being separated by a sole middle part;

each said heel area sole side comprising a concavely rounded portion of both the inner surface of the midsole component and an outer surface of the sole, as viewed ill a sole heel area frontal plane cross section during an unloaded, upright shoe sole condition, the concavity existing with respect to an intended wearer's foot location in the shoe;

each said heel area sole side further includes said concavely rounded portion of the sole outer surface extending substantially continuously through and beyond a sidemost extent of the same said heel area sole side, as viewed in a sole heel area frontal plane cross section during an unloaded, upright shoe sole condition;

each said heel area sole side also includes both the midsole component and the outsole component extending into the sidemost section of the same said heel area sole side, as viewed in a sole heel area frontal plane cross section during an unloaded, upright shoe sole condition;

each said heel area sole side further includes an upper part of said midsole component extending up said heel area sole side to above a level corresponding to a lowest point of the inner surface of the midsole component of the same said heel area sole side, as viewed in a sole heel area frontal plane cross section during an unloaded, upright shoe sole condition;

at least one midtarsal area sole side located at one of a sole medial side and a sole lateral side, said lateral and medial sides being separated by a sole middle part;

each said midtarsal area sole side comprising a concavely rounded portion of both the inner surface of the midsole component and the outer surface of the sole, as viewed in a sole midtarsal area frontal plane cross section during an unloaded, upright shoe sole condition, the concavity existing with respect to an intended wearer's foot location in the shoe;

each said midtarsal area sole side further includes said concavely rounded portion of the sole outer surface extending up said midtarsal area sole side to at least a level corresponding to a lowest point of the inner surface of the midsole component of the same said midtarsal area sole side, as viewed in a sole midtarsal area frontal plane cross section during an unloaded, upright shoe sole condition;

each said midtarsal area sole side also includes the midsole component extending into the sidemost section of the same said midtarsal area sole side, as viewed in a sole midtarsal area frontal plane cross section during an unloaded, upright shoe sole condition;

each said midtarsal area sole side further includes an upper part of the midsole component extending up said midtarsal area sole side to above a level corresponding to a lowest point of the inner surface of the midsole component of the same said midtarsal area sole side, as viewed in a sole midtarsal area frontal plane cross section during an unloaded, upright shoe sole condition;

said midtarsal area sole side is located at least at the sole lateral side; and the sole outer surface of at least part of the sole midtarsal area is substantially convexly rounded, as viewed in a shoe sole sagittal plane cross section during an unloaded, upright shoe sole condition, the convexity existing with respect to an intended wearer's foot location in the shoe.

2. The shoe sole according to claim 1, wherein a thickness between the inner surface of the midsole component and the outer surface of the sole tapers by decreasing gradually and substantially continuously from above a sidemost extent of the sole side to the uppermost point of the sole side, as viewed in a sole midtarsal area frontal plane during an upright, unloaded shoe sole condition; and said thickness is defined as the distance between a first point on the inner surface of the midsole component and a second point on the outer surface of the sole, said second point being located along a straight line perpendicular to a straight line tangent to the inner surface of the midsole component at said first point, as viewed in a shoe sole frontal plane in an upright, unloaded shoe sole condition.

3. The shoe sole according to claim 1, wherein said heel area sole side is located at the sole lateral side.

4. The shoe sole according to claim 1, wherein said heel area sole side is located at the sole medial side.

5. The shoe sole according to claim 1, wherein said heel area sole side is located at the sole lateral side, and said midtarsal area sole side is located also at the sole medial side.

6. The shoe sole according to claim 1, wherein said heel area sole side is located at the sole medial side, and said midtarsal area sole side is located also at the sole medial side.

7. The shoe sole according to claim 1, wherein said heel area sole sides are located at both the sole lateral side and the sole medial side.

8. The shoe sole according to claim 1, wherein said sole lateral side and said sole medial side each include one of said heel area sole sides, and said midtarsal area sole side is also located at the sole medial side.

9. The shoe sole according to claim 1, wherein the sole outer surface and the sole inner surface of a rearmost part of the sole heel area include a concavely rounded portion, as viewed in a shoe sole sagittal plane cross section during an unloaded, upright shoe sole condition, the concavity existing with respect to an intended wearer's foot location in the shoe; and wherein an upper part of the midsole component of the rearmost part of the sole heel area extends up a rear of the sole heel area to above the level of the lowest point of the sole inner surface of the rear of the sole heel area, as viewed in a shoe sole sagittal plane cross section during an unloaded, upright shoe sole condition.

* * * * *